US007487783B2

(12) United States Patent
Saito

(10) Patent No.: US 7,487,783 B2
(45) Date of Patent: Feb. 10, 2009

(54) THREADING UNIT AND METHOD OF THREADING

(75) Inventor: Tadashi Saito, Haga-gun (JP)

(73) Assignee: Kao Corporation, Tokyo (JP)

( * ) Notice: Subject to any disclaimer, the term of this patent is extended or adjusted under 35 U.S.C. 154(b) by 802 days.

(21) Appl. No.: 10/900,097

(22) Filed: Jul. 28, 2004

(65) Prior Publication Data

US 2005/0061351 A1 Mar. 24, 2005

(30) Foreign Application Priority Data

Jul. 31, 2003 (JP) ..... 2003-204756

(51) Int. Cl.
*A45D 7/02* (2006.01)

(52) U.S. Cl. ..... 132/212

(58) Field of Classification Search ..... 132/212, 132/223, 224, 227, 228, 222, 270, 200; 112/475.01, 112/1

See application file for complete search history.

(56) References Cited

U.S. PATENT DOCUMENTS 5,025,850 A * 6/1991 Simpson ..... 132/225
2004/0231689 A1* 11/2004 Kobayashi et al. ..... 132/222

FOREIGN PATENT DOCUMENTS

JP 2003-33216 2/2003
JP 2003-93133 4/2003

* cited by examiner

*Primary Examiner*—Robyn Doan
*Assistant Examiner*—Rachel A Running
(74) *Attorney, Agent, or Firm*—Oblon, Spivak, McClelland, Maier & Neustadt, P.C.

(57) ABSTRACT

A threading unit for threading a thread through holes of a sheet-like flat member, including an upper block (2) and a lower block (3) mating with each other and each having formed therein a discontinuous vessel having apertures open on the respective mating surfaces. The upper and lower blocks, when joined together, have their discontinuous vessels connected to each other to complete a continuous vessel through which a thread is threaded. The upper and lower blocks are each split into a first upper piece (2A) and a second upper piece (2B) and a first lower piece (3A) and a second lower piece (3B), respectively, along the parting face. Each split has on its parting face a lengthwise cut half of the discontinuous vessel. The sheet-like flat member is sandwiched between the mating faces of the upper and lower blocks (2) and (3) with its holes coinciding with the apertures of the upper and lower blocks.

12 Claims, 9 Drawing Sheets

THREADING UNIT AND METHOD OF THREADING

FIELD OF THE INVENTION

The present invention relates to a threading unit used to thread a thread through a plurality of holes of a sheet-like flat member, a threading method using the threading unit, a method of making a threaded article, a method of making a hair holder using the threading unit, and an apparatus used to carry out the method of producing a hair holder.

BACKGROUND OF THE INVENTION

JP-A-2003-33216 and JP-A-2003-93133, both filed by Kao Corp., disclose a hair holder having a tube with a hair inlet at one end thereof through which a strand of hair can be inserted and a curling thread for curling the tube. The tube has holes bored at a spacing through which the thread is sequentially passed and thereby disposed on the outer side of the tube.

While the publications have no mention of means for threading the thread through the holes of the tube, threading is generally done by catching thread on or through a pin, e.g., a needle and passing the pin with thread through the holes one by one. However, threading using a pin such as a needle is cumbersome and unfit for large-volume production.

This problem is encountered in threading not only the tube described in the publications cited supra but also any other sheet-like flat articles.

SUMMARY OF THE INVENTION

The present invention provides a threading unit used for threading a sheet-like flat member having a plurality of holes allowing thread to pass through. The threading unit has an upper block and a lower block mating with each other and each having formed therein a discontinuous vessel allowing a length of thread to be threaded therethrough. The discontinuous vessel of each of the upper and the lower blocks has apertures open on the mating surface. When mated with each other, the upper block and the lower block have their discontinuous vessels connected to each other to complete a continuous vessel having a first end and a second end. The upper block is adapted to be split into a first upper piece and a second upper piece along a parting face, each having on the parting face a lengthwise cut half of the discontinuous vessel. The lower block has the same configuration. The threading unit is adapted to have the sheet-like flat member sandwiched between the mating faces of the upper and lower blocks in such a configuration that the holes of the sheet-like flat member coincide with the apertures of the upper and lower blocks.

The present invention provides a method for threading a sheet-like flat member having a plurality of holes allowing thread to pass through by using the threading unit of the invention. The method includes sandwiching the sheet-like flat member between the mating faces of the upper and the lower blocks of the threading unit with its holes coinciding with the apertures of the mating faces of the upper and the lower blocks and threading a thread through the continuous vessel of the threading unit from the first end of the continuous vessel by evacuating the continuous vessel from the second end thereof.

The present invention provides a method of making a threaded article from a sheet-like flat member having holes allowing thread to pass through by passing a thread through the holes of the sheet-like flat member using the above-described threading unit. The method includes sandwiching the sheet-like flat member between the mating faces of the upper and the lower blocks of the threading unit with its holes coinciding with the apertures of the upper and the lower blocks and threading a thread through the continuous vessel of the threading unit from the first end of the continuous vessel by evacuating the continuous vessel from the second end thereof.

The present invention also provides a method of producing a hair holder by using the above-described threading unit. The hair holder has a tube with a hair inlet at one end thereof through which a strand of hair can be inserted and a curling thread for curling the tube. The tube has holes bored at a spacing through which the thread is threaded sequentially, whereby the thread is disposed on the outer side of the tube. The method includes sandwiching the tube between the mating faces of the upper and the lower blocks of the threading unit with its holes coinciding with the apertures of the upper and the lower blocks and threading a thread through the continuous vessel of the threading unit from the first end by evacuating the continuous vessel from the second end thereof.

The present invention also provides an apparatus for producing a hair holder that is used to carry out the aforementioned method of producing a hair holder. The apparatus includes the threading unit of the present invention, a thread feed unit for feeding a thread to the first end of the continuous vessel of the threading unit, and an evacuation unit for evacuating the continuous vessel from the second end thereof. The apparatus is adapted to have the above-described tube sandwiched between the mating faces of the upper and the lower blocks of the threading unit with the holes of the tube being coincident with the apertures of the upper and the lower blocks. In this state, the thread feed unit introduces a thread into the first end of the continuous vessel while the evacuation unit evacuates the continuous vessel from the second end thereof. As a result, the thread is threaded through the continuous vessel from the first to the second ends.

DETAILED DESCRIPTION OF THE PREFERRED EMBODIMENTS

The present invention relates to a threading unit with which a thread can easily be threaded through the holes of a sheet-like flat member (e.g., a tube), a threading method and a method of making a threaded article using the threading unit, and a method and an apparatus for making a hair holder using the threading unit.

The present invention will be described generally based on its preferred embodiments with reference to the accompanying drawings. As will be understood, the hair holder described hereunder is a preferred embodiment of a threaded article produced in accordance with the present invention.

A hair holder, which is an example of a sheet-like flat member threaded with a thread using the threading unit and the threading method according to the present invention, is described with reference to FIG. 1.

The term "sheet-like flat member" as used herein is intended to include anything that is flat as a whole and is, for the most part, made of a sheet material. The sheet-like flat member includes, but is not limited to, a single sheet, a tube made of a single sheet, a bag made of a single sheet, two or more sheets merely superposed on each other, a tube made of two or more sheets, and a bag made of two or more sheets. The tubes and the bags include those having a flattened shape as produced and those having an inflated shape with no external force applied but easy to flatten when pressed crosswise.

The hair holder to be produced by the method and apparatus according to the present invention is a tube, a kind of the above-defined sheet-like flat member, having a thread on its outer surface. More specifically, the hair holder has a tube with a hair inlet at one end thereof, in which a strand of hair can be inserted and accommodated, and a thread for curling (e.g., rolling) the tube. The tube has holes bored through its wall at a spacing. The thread is threaded through the holes in sequence to appear on the outer surface of the tube.

Figure 1:
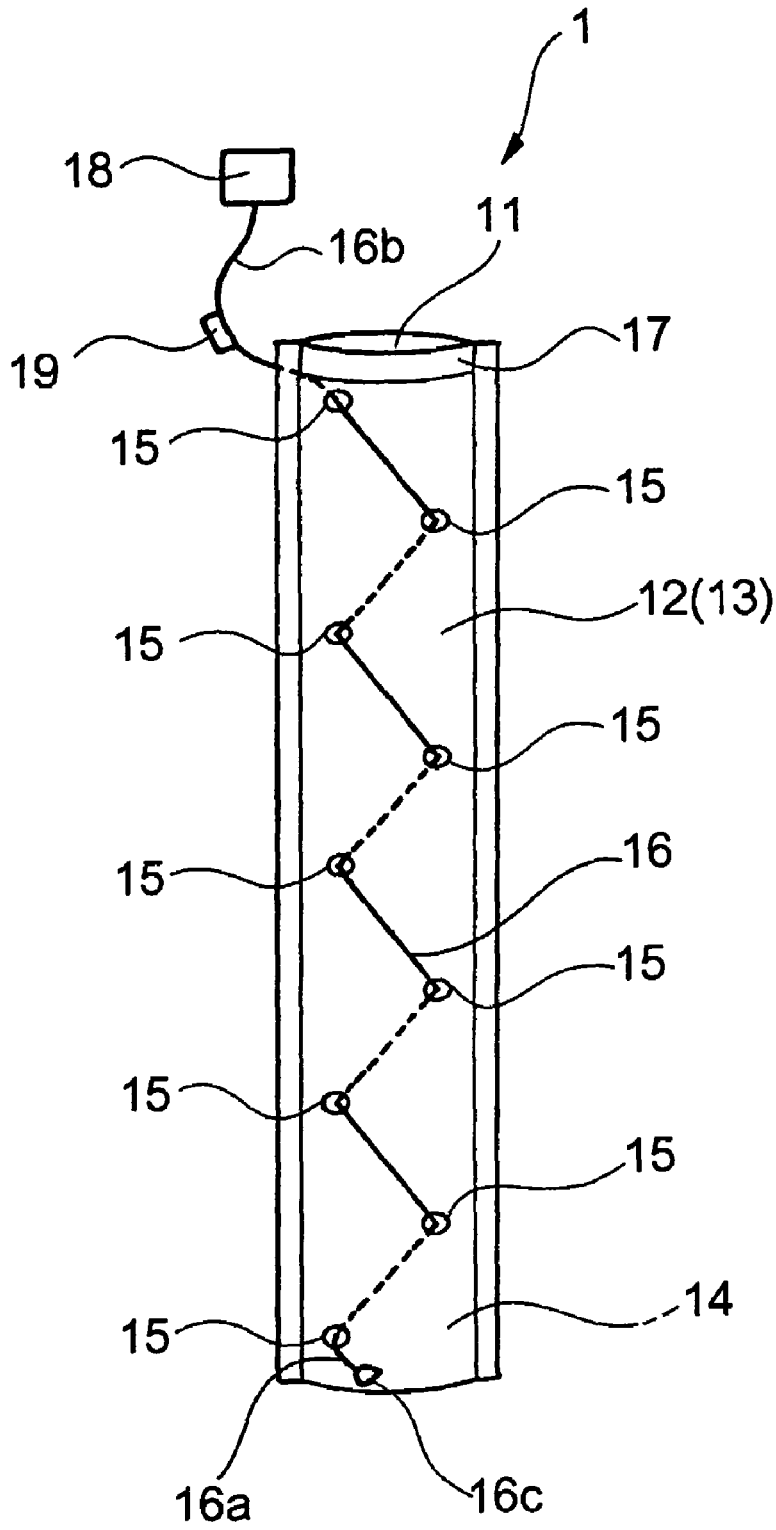
FIG. 1 is a perspective front view of a hair holder produced by the present invention.
Figure 2:
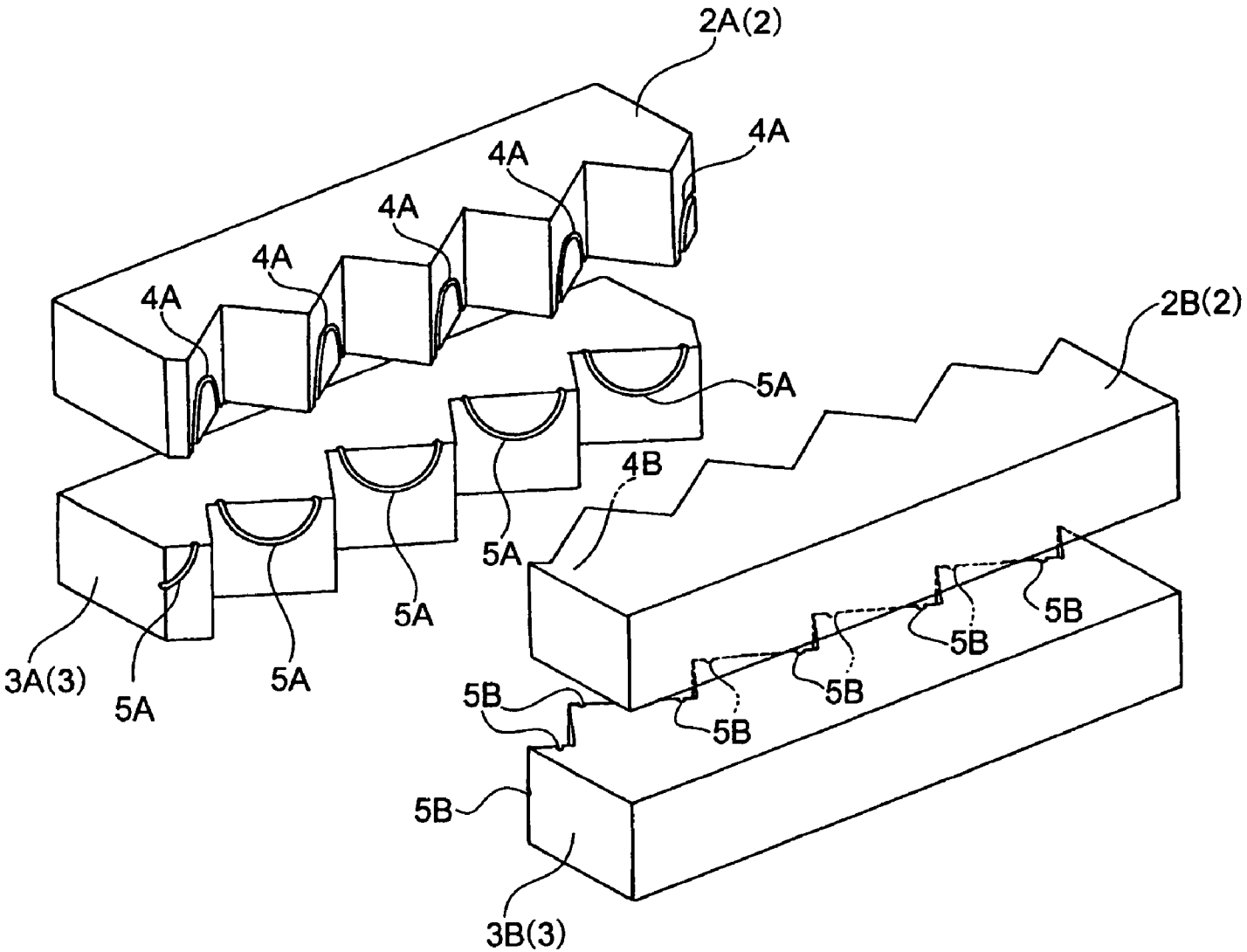
FIG. 2 is a perspective of an embodiment of the threading unit according to the present invention, in which the upper and the lower blocks are separated apart, and each of the upper and the lower blocks is split into two pieces.

FIG. 1 shows an example of such a hair holder. The hair holder 1 shown in FIG. 1 is a tube 12 having a thread 16 with which to curl the tube 12. The tube 12 has a hair inlet 11 at one end thereof so that a strand of hair can be inserted therein from the inlet 11. The tube 12 is made of two strips, a strip 13 and a strip 14 forming the front and the rear sides, respectively, joined together at both of their longer sides. The hair inlet 11 is reinforced with a reinforcing member 17. When the tube 12 is viewed from the front, holes 15 are punched right through the strips 13 and 14. The holes 15 are arranged at a certain spacing in a zig zag pattern along the length of the tube 12.

The tube 12 has a curling thread 16 threaded through its holes 15 in order from the hole nearest to the hair inlet 11 (the upper most hole in FIG. 1) toward the hole nearest to the other end of the tube so that the thread may depict the above-defined zig zag line. It follows that the thread 16 appears alternately on the outer side of the strip 13 and the outer side of the strip 14.

The end 16*a* of the thread 16 (the lower end in FIG. 1) is fixed to the outer side of the strip 13. The reference character 16*c* indicates the joint. The other end 16*b* of the thread 16 (the upper end in FIG. 1) emerging from the uppermost hole 15 of the strip 14 remains free. The free end 16*b* of the thread 16 is provided with a tag 18, which is to be pinched and pulled for curling the tube 12. A stopper 19 is provided to the thread 16 between the tag 18 and the uppermost hole 15 so as to allow the adjacent part of the other end 16*b* of the thread 16 to temporarily stop at the hair inlet 11.

The materials and dimensions of the members making up the hair holder 1 are selected appropriately in accordance with desired performance properties.

The strips 13 and 14 can be of various flexible materials, such as nonwoven fabric, porous or non-porous resin film, paper, and composites thereof. The length of the tube 12 is decided appropriately according to the use.

The curling thread 16 preferably has sufficient strength not to be cut when pulled to curl the hair and flexibility enough to smoothen the pulling operation. From that viewpoint, the thread 16 is preferably made of synthetic materials such as various resins, naturally occurring materials such as cotton or hemp, semi-synthetic materials such as rayon, various metals, or composites thereof. The curling thread 16 is not limited to a thread and may be a ribbon.

The so designed hair holder 1 is used as follows. A strand of hair is inserted into the tube 12 from the hair inlet 11. The insertion of hair is preferably carried out with a hair inserter. The tag 18 is pinched and pulled up, whereby the hair is rolled up into a polygonal shape, e.g., a triangle or a hexagon, when viewed with the pulling direction as a visual axis. What polygonal shape the hair is rolled in depends on the zig zag angle of the thread 16 with respect to the longitudinal direction of the tube 12.

An embodiment of the threading unit of the present invention and an embodiment of the apparatus for producing a hair holder are then described by referring to FIGS. 2 through 7. These embodiments are preferably used to produce the above-described hair holder 1, specifically, to lace a thread through the holes of the tube (sheet-like flat member). An embodiment of the threading method according to the present invention and an embodiment of the method for producing a hair holder according to the present invention will also be described in the description infra.

The threading unit according to the present embodiment is shown in FIGS. 1 to 6. The threading unit of this embodiment is used to lace (thread) a thread 16 through the holes 15 of the sheet-like flat member (tube 12). The threading unit is composed of an upper block 2 having a discontinuous vessel formed of discontinuous troughs 4A and 4B and a lower block 3 having a discontinuous vessel formed of discontinuous troughs 5A and 5B. When the upper block 2 and the lower block 3 are superposed on each other on their mating faces, the discontinuous vessel of the upper block 2 (i.e., troughs 4A and 4B) and that of the lower block 3 (i.e., troughs 5A and 5B) are connected to form a continuous vessel 6. The upper block 2 is split into a first upper piece 2A and a second upper piece 2B in such a manner that the discontinuous vessel is cut lengthwise into the discontinuous troughs 4A and 4B. Similarly, the lower block 3 is split into a first lower piece 3A and a second lower piece 3B in such a manner that the discontinuous vessel is cut lengthwise into the discontinuous troughs 5A and 5B. The threading unit of the present embodiment is designed such that the upper block 2 and the lower block 3 are brought into contact on their mating faces with the sheet-like flat member (tube 12) sandwiched therebetween. The tube 12 is positioned such that the holes 15 may coincide with the apertures of discontinuous vessels 4A, 4B, 5A, and 5B on the mating faces of the upper block 2 and the lower block 3.

The terms "upper" and "lower" for the blocks 2 and 3 are used only for the sake of ease of explanation and do not necessarily indicate the positional relationship of these blocks. For example, the blocks 2 and 3 may be disposed side by side, or the block 3 may be superposed on the block 2.

Each of the upper block 2 and the lower block 3 is a rectangular block. They can be of any material, such as metals, synthetic resins or wood, as long as the discontinuous vessel can be formed therein. In this particular embodiment, metal blocks are selected for abrasion resistance.

As shown in FIGS. 2 to 4, 5(*a*), and 5(*b*), the upper block 2 is split into halves along a zig zag parting line when seen from above. Likewise the lower block 3 is split into halves along a zig zag parting line when seen from above.

Figure 4:
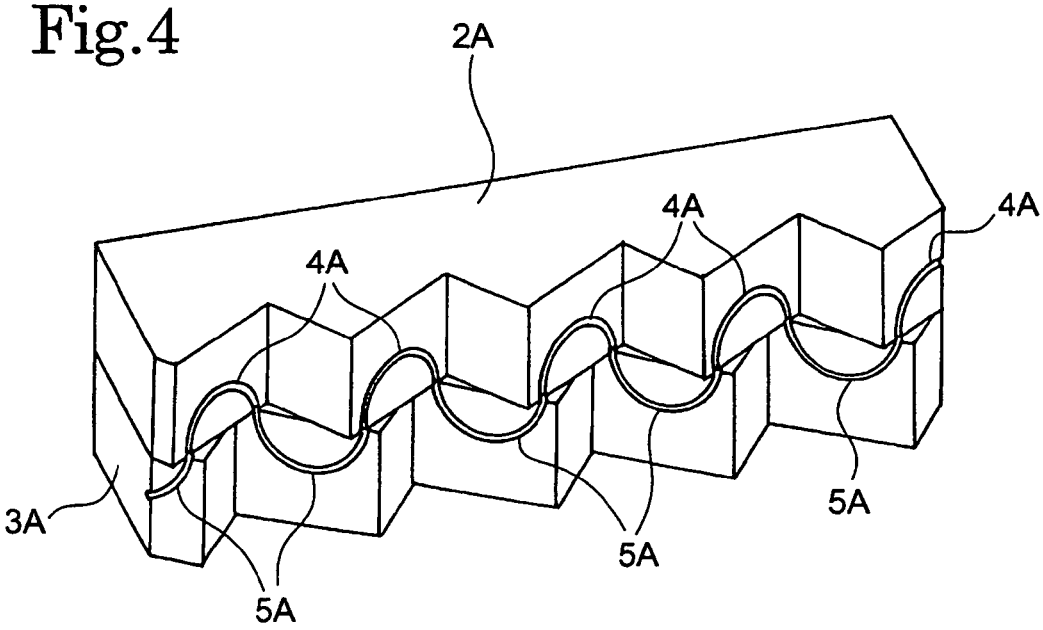
FIG. 4 is a perspective of the first upper piece and the first lower piece of the threading unit of FIG. 2, superposed on each other to form a wavy continuous trough (a lengthwise cut half of a wavy vessel).

As shown in FIG. 4, the zig zag parting line of the first upper piece 2A and that of the first lower piece 3A are equal in number and pitch of mountains but different in shape of mountains. The straight lines connected in zig zag of the first upper piece 2A and those of the first lower piece 3A are crossing with each other when seen from above.

The parting face of the first upper piece 2A, being composed of subfaces each defined by the top and the foot of the mountains, has a discontinuous trough 4A with a semicircular cross-section formed on every other subface. The discontinuous trough 4A is an array of individual troughs each having the shape of an upward protruding half circle arc or an upward protruding quarter circle arc. The term "trough" as used herein means a lengthwise cut half of a vessel having a circular cross-section. Similarly, the parting face of the first lower piece 3A, being composed of subfaces each defined by the top and the foot of the mountains, has a discontinuous trough 5A with a semicircular cross-section formed on every other subface. The discontinuous trough 5A is an array of individual troughs each having the shape of a downward protruding half circle arc or a downward protruding quarter circle arc.

As shown in FIG. 4, on superposing the first upper piece 2A and the first lower piece 3A on each other at right positions, the individual troughs 4A of the former and the individual troughs 5A of the latter connect to each other thereby to complete a continuous trough. The complete continuous trough has a wavy form (i.e., consecutively connected half circle arcs) starting from one longitudinal end of the first lower piece 3A and ending at the opposite side end of the first upper piece 2A.

The second upper piece 2B and the second lower piece 3B are counter parts of the first upper piece 2A and the first lower piece 3A, respectively. On superposing the second upper piece 2B and the second lower piece 3B on each other at right positions, the individual troughs 4B of the former and the individual troughs 5B of the latter connect to each other thereby to complete a continuous trough. The complete continuous trough has a wavy form (i.e., consecutively connected half circle arcs) starting from one longitudinal end of the second lower piece 3B and ending at the opposite side end of the second upper piece 2B.

Figure 3:
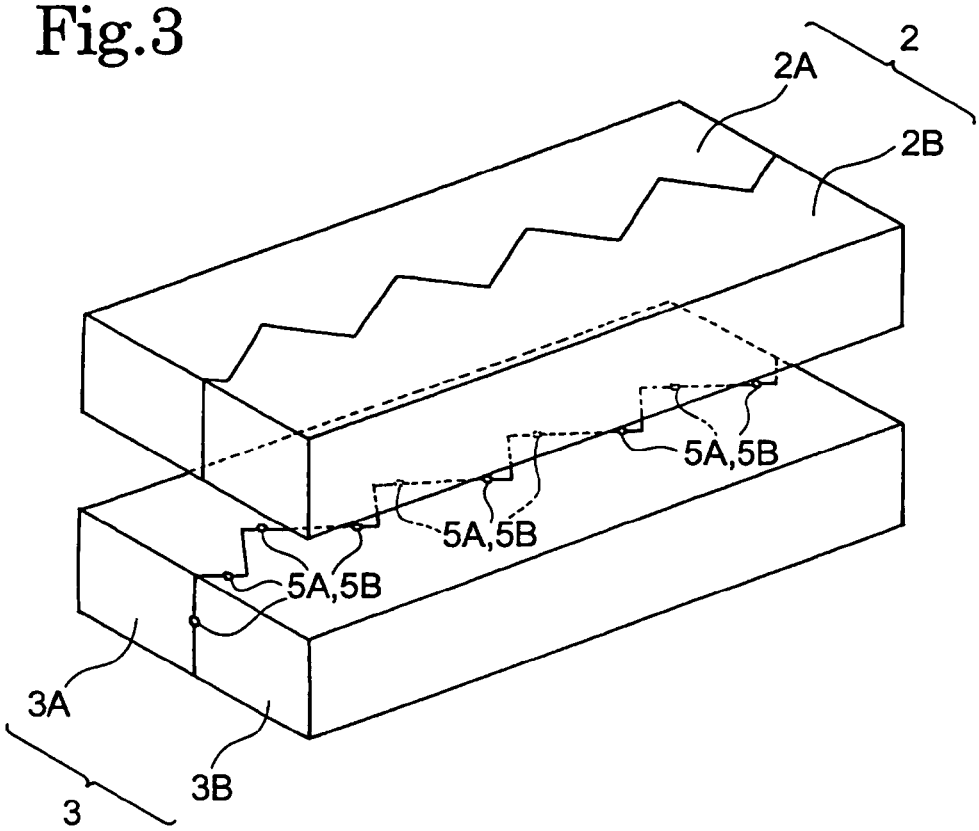
FIG. 3 is a perspective of the threading unit of FIG. 2, in which the upper and the lower blocks are separated apart, and each of the upper and lower blocks is not split into two pieces.

Upon joining the first upper piece 2A and the second upper piece 2B on their parting faces to form the upper block 2, joining the first lower piece 3A and the second lower piece 3B on their parting faces to form the lower block 3 as shown in FIG. 3, and mating the upper block 2 and the lower block 3 with each other on their mating faces at right positions, there is completed a wavy continuous vessel 6 having a first end and a second end and a circular cross-section and extending from one longitudinal end to the other of the threading unit. One end of the continuous vessel 6 is located in the lower block 3, while the other end in the upper block 2.

The first lower piece 3A and the second lower piece 3B are not only transversely movable to mate at their parting faces or separate from each other but vertically movable to mate with or separate from the upper block 2. The first upper piece 2A and the second upper piece 2B are not only transversely movable to mate at their parting faces or separate from each other but vertically movable to mate with or separate from the lower block 3. Well-known mechanisms can be used to produce these movements of the upper block 2 and the lower block 3.

The embodiment of the apparatus for producing a hair holder using the aforementioned threading unit will be described with reference to FIGS. 2 through 7.

The apparatus of the present embodiment includes the threading unit of the above-described embodiment, a thread feed unit 7 for feeding a thread T (the thread 16) to the first end of the continuous vessel 6 of the threading unit (shown in FIG. 7), and an evacuation unit (not shown) for evacuating the continuous vessel 6 from the second end thereof. The apparatus is adapted to have the tube 12 sandwiched between the mating faces of the upper block 2 and the lower block 3 with the holes 15 of the tube 12 coinciding with the apertures of the discontinuous troughs 4A, 4B, 5A, and 5B that are open on the mating faces of the upper block 2 and the lower block 3. This state of the threading unit will hereinafter be referred to as an assembled state. With the threading unit in the assembled state, the thread feed unit 7 introduces the thread T continuously into the first end of the continuous vessel 6 while the evacuation unit evacuates the continuous vessel 6 from the second end thereof to generate a high-speed air flow through the vessel 6. As a result, the thread T threads through the continuous vessel 6 from the first to the second ends.

In order to sequentially thread the thread T through the holes 15 of the tube 12, the tube and the threading unit to be combined should be so configured that the apertures of the discontinuous vessels of the upper and lower blocks and the holes of the tube 12 may be in good coincidence.

The thread feed unit 7 is described with reference to FIG. 7. The thread feed unit 7 is set near the first end of the continuous vessel 6 of the threading unit in the state that the first upper piece 2A and the second upper piece 2B are joined on their parting faces to form the upper block 2, the first lower piece 3A and the second lower piece 3B are joined on their parting faces to form the lower block 3, and the upper block 2 and the lower block 3 are mated with each other on their mating faces at right positions (here in after refered to as "the assembled state").

The thread feed unit 7 includes a vertically disposed pair of feed rollers 71A and 71B and a guide 72 that houses the feed rollers 71A and 71B. Thread T that finally becomes the curling thread 16 passes between the feed rollers 71A and 71B and through the guide 72. The feed rollers 71A and 71B rotate in opposite directions to carry the thread T according to the rotate direction.

Figure 5A:
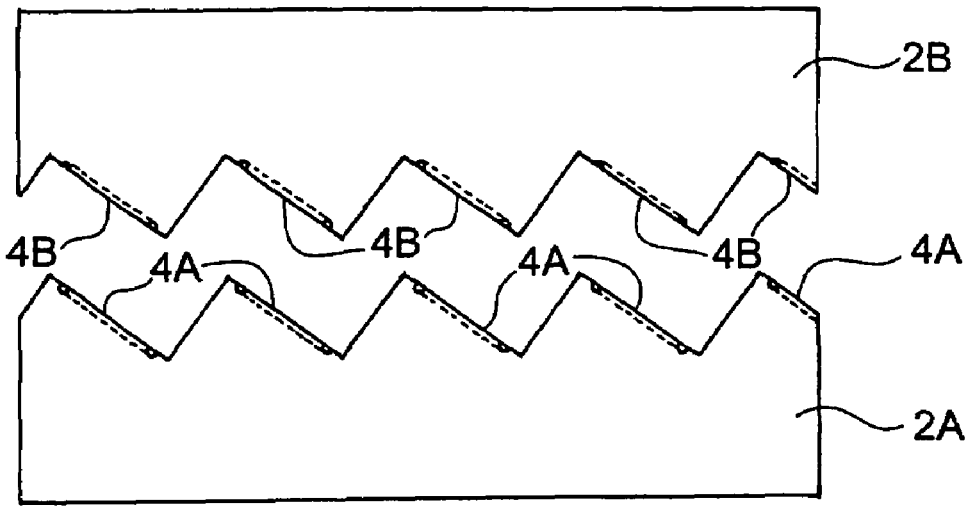
FIG. 5(*a*) is a bottom view of the upper block of the threading unit of FIG. 2, and FIG. 5(*b*) is a plan view of the lower block of the threading unit of FIG. 2.
Figure 5B:
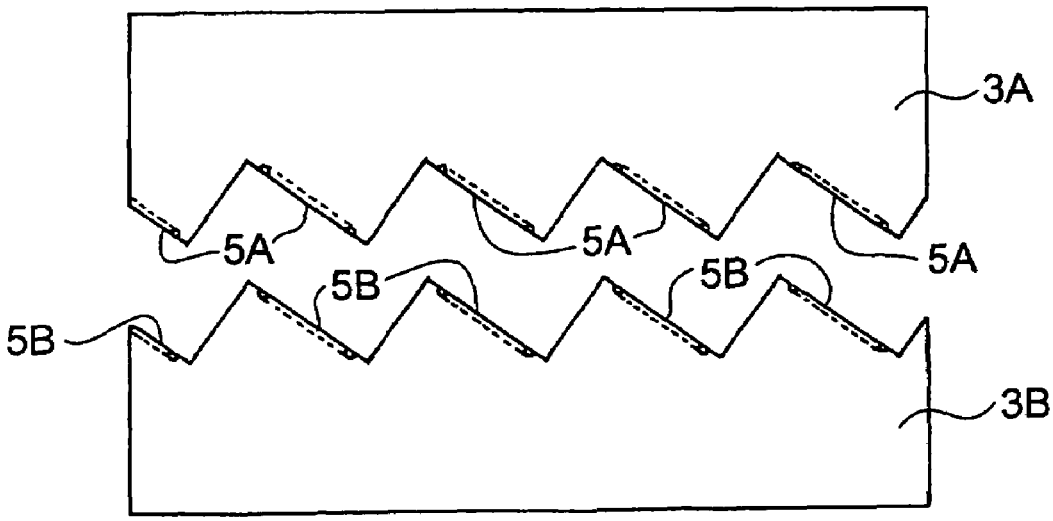

The thread exit side of the guide 72 (the right-hand side in FIG. 7) faces to the first end side of the upper block 2 and the lower block 3 (the left-hand side in FIGS. 5(*a*) and 5(*b*)). A buffer 73 functioning as a temporary thread storage zone is provided on the opposite side of the guide 72 (the left-hand side in FIG. 7), namely upstream the guide 72.

The thread feed unit 7 is also capable of pulling back the thread T that has been fed from the exit side of the guide 72 into the upstream buffer 73 by rotating the pair of the feed rollers 71A and 71B in the directions reverse to those in feeding the thread T. In other words, the thread feed unit 7 also operates to withdraw the thread T in the direction opposite to the threading direction.

The evacuation unit (not shown) capable of evacuating the continuous vessel 6 to a negative pressure is installed outside of the second end of the wavy continuous vessel 6 of the threading unit in the assembled state. While various evacuation mechanisms are employable, a vacuum pump is adopted in this particular embodiment. It is preferred to use a vacuum pump capable of creating a degree of vacuum of several tens of kilopascals.

A thread fixing part for temporarily fixing the leading end of the thread T is provided between the second end of the continuous vessel 6 and the evacuation unit. Alternatively, the evacuation unit is movably set in contact with the second end of the continuous vessel 6 so that it can withdraw to allow an independent thread fixing unit to fix the exposed leading end of the thread T temporarily.

Figure 8:
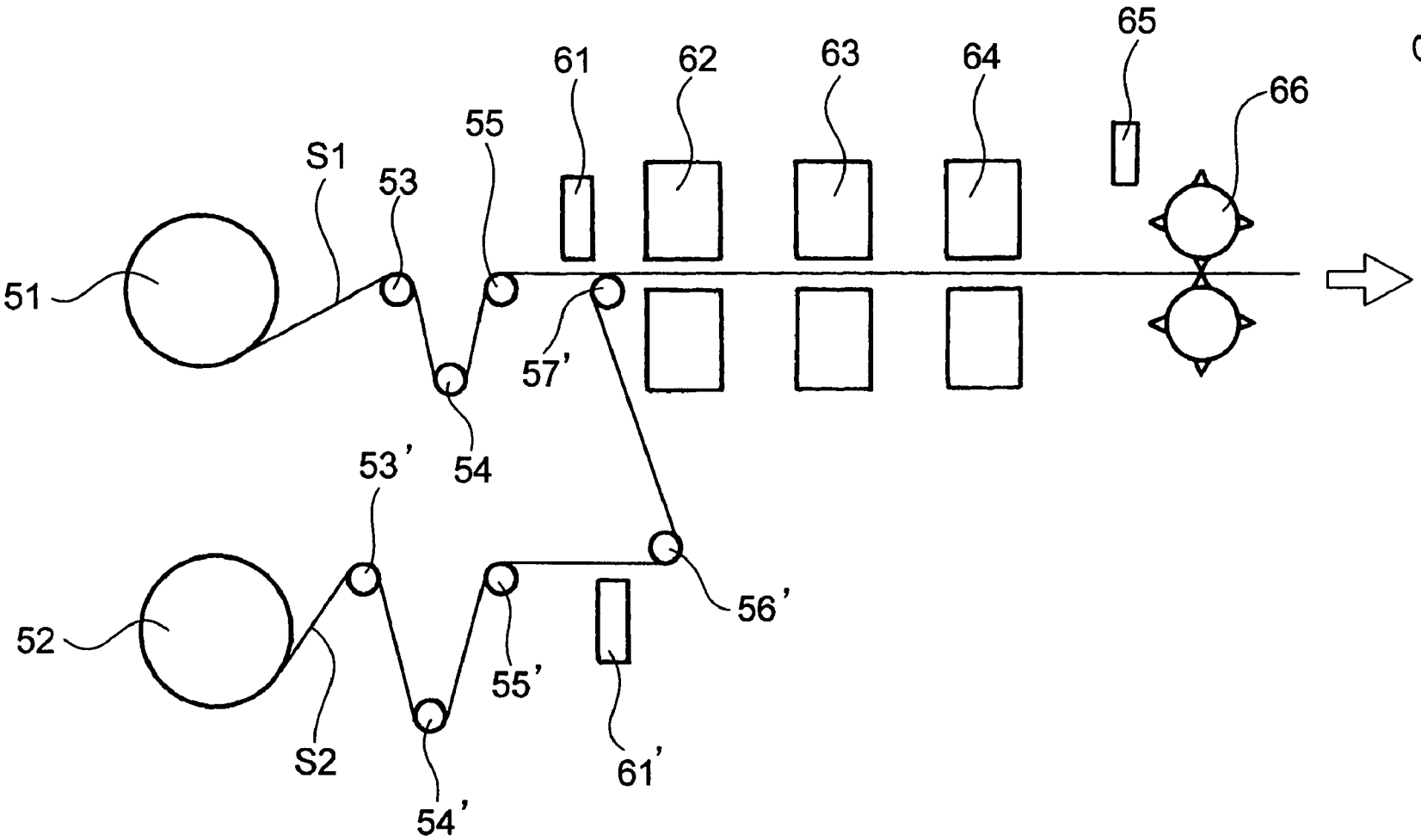
FIG. 8 is a schematic diagram showing the whole system for producing a hair holder including the apparatus according to the present invention.
Figure 9A:
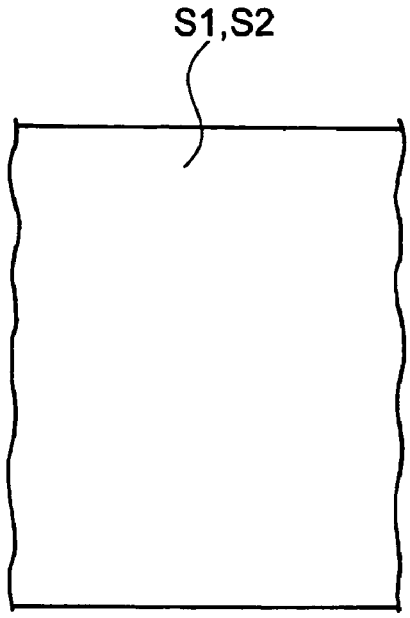
FIG. 9(*a*), FIG. 9(*b*), FIG. 9(*c*), and FIG. 9(*d*) are plans of a sheet material in the steps upstream an embodiment of the apparatus according to the present invention.
Figure 9B:
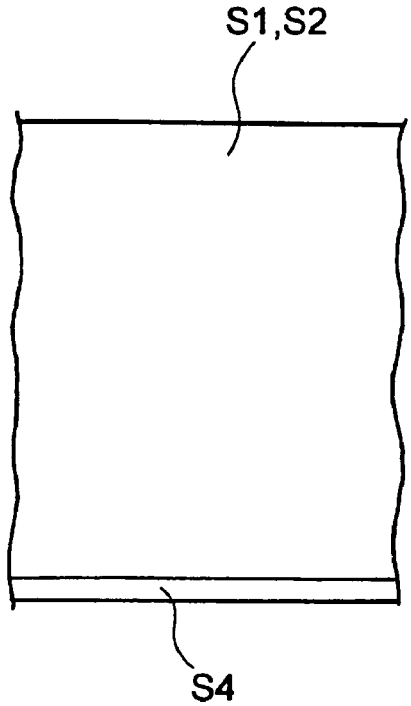
Figure 9C:
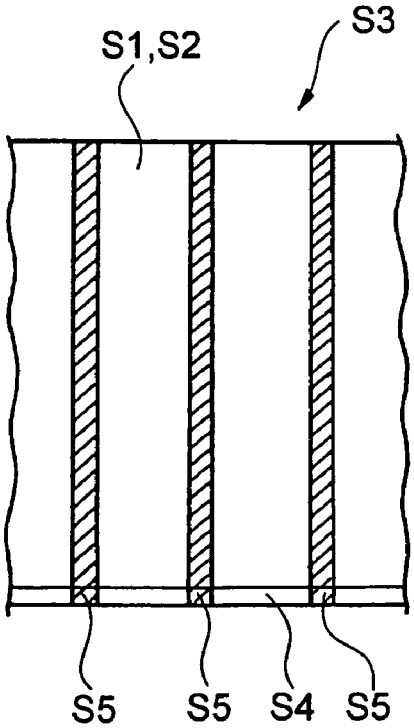
Figure 9D:
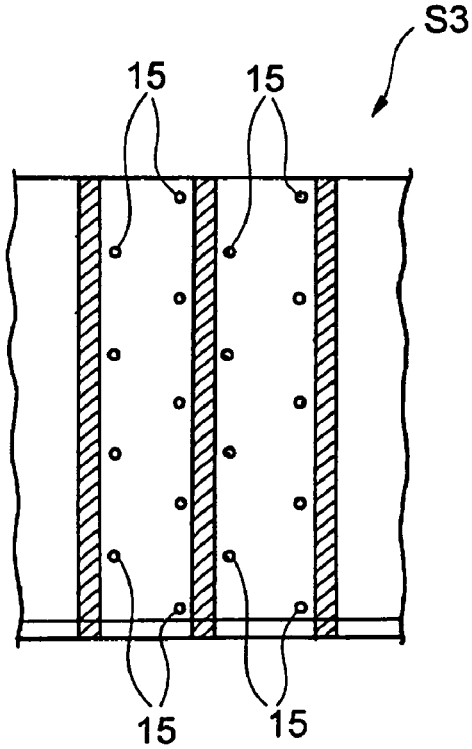
Figure 10A:
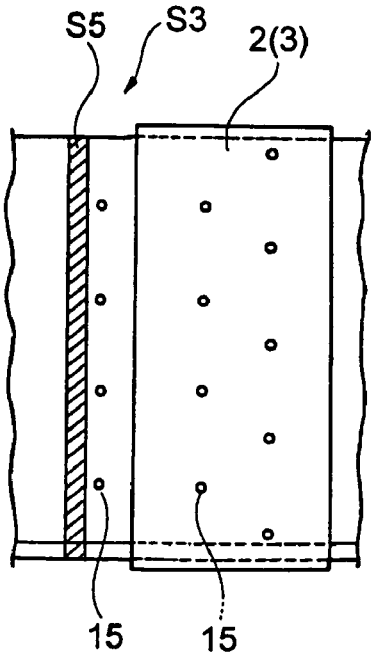
FIG. 10(*a*), FIG. 10(*b*), FIG. 10(*c*), and FIG. 10(*d*) are plans of a sheet material in the steps downstream the embodiment of the apparatus according to the present invention.
Figure 10B:
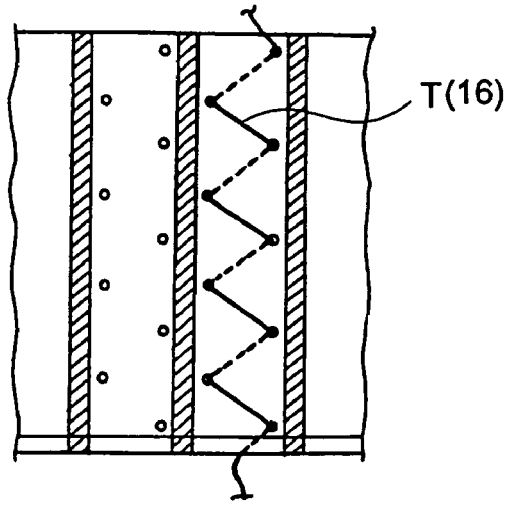
Figure 10C:
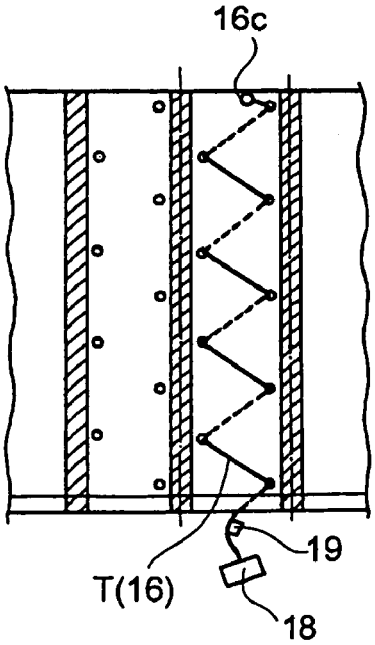
Figure 10D:
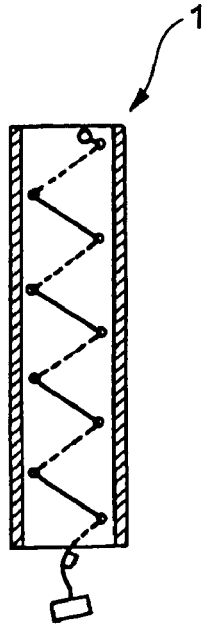

In the production of the hair holder, additional steps or units are provided upstream and downstream the above-described threading step using the apparatus of the present embodiment. These additional steps or units will be described by referring to FIGS. 8 through 10. In FIG. 8, numeral 64 indicates the apparatus of the present embodiment.

As shown in FIG. 8, a stock roll 51 of a continuous sheet S1, which finally becomes the strip 13, and a stock roll 52 of a continuous sheet S2, which finally becomes the strip 14, are placed upstream the apparatus 64.

Guide rollers 53, 54, and 55 are arranged for guiding the continuous sheet S1 from the stock roll 51. Guide rollers 53', 54', 55', and 56' are provided for guiding the continuous sheet S2 from the stock roll 52. The continuous sheet S1 guided by roller 55 and the continuous sheet S2 guided by the roller 56' are superposed on each other on a roller 57'.

Reinforcing member attaching units 61 and 61' are provided between the rolls 55 and 57' in the pass of the continuous sheet S1 and between the rolls 55' and 56' in the pass of the continuous sheet S2, respectively.

Upstream the apparatus 64, a reinforcing member attaching units 61 and 61', a sealing unit 62 and a punching unit 63 are provided. In the reinforcing member attaching units 61 and 61', a reinforcing member S4 (which finally becomes a reinforcing member 17) in continuous form is attached along one edge of the continuous sheets S1 and S2, respectively, having been guided by the guide rollers 55 and 55', respectively (see FIGS. 9(*a*) and 9(*b*)). The continuous sheets S1 and S2 both reinforced by the respective reinforcing members S4 are superposed on each other on the roller 57'.

Downstream the roller 57' is provided a sealing unit 62, where the superposed continuous sheets S1 and S2 are crosswise sealed at a regular interval to form a multi-tubular sheet S3, i.e., a continuous row of flat tubes linked side-by-side via joints S5 as shown in FIG. 9(*c*).

Downstream the sealing unit 62 and upstream the apparatus 64 is provided a punching unit 63, where holes 15 are punched through every tube of the multi-tubular sheet S3 as shown in FIG. 9(*d*). The punched multi-tubular sheet S3 is then forwarded to the apparatus 64, for producing a hair holder of the above described embodiment where a thread is threaded through the holes 15 of every tube of the multi-tubular sheet S3 (see FIG. 10(*b*)).

Downstream the apparatus 64, a thread end finishing unit 65 is provided as shown in FIG. 8, where the two ends of the thread T threaded through each tube are finished. The thread end finishing includes fixing one end of the thread T on the surface of the tube (see FIG. 10(*c*)).

Downstream the thread end finishing unit 65 is placed a cutting unit 66, where the threaded multi-tubular sheet S3 is cut along the center line of every joint S5 to produce hair holders 1 in a continuous manner (see FIGS. 10(*c*) and 10(*d*)).

Usage of the apparatus of the present embodiment will be explained together with description of the threading method according to the present invention and the method of producing a hair holder according to the present invention with reference to their preferred embodiments.

As shown in FIG. 8, continuous sheets S1 and S2 are unwound from the respective stock rolls 51 and 52 and forwarded to the respective reinforcing member attaching units 61 and 61' with sag having been removed while being guided on the guide rollers 53, 54, 55, 53', 54', and 55' (see FIG. 9(*a*)).

In the reinforcing member attaching units 61 and 61', a reinforcing member S4 of continuous form is adhered to one edge of the sheets S1 and S2, respectively, as shown in FIG. 9(*b*). The edge-reinforced sheets S1 and S2 are joined together on the roller 57' and sent to the sealing unit 62, where they are crosswise sealed at a regular interval to form a multi-tubular sheet S3, i.e., a continuous row of tubes linked side-by-side via joints S5 as shown in FIG. 9(*c*). The joints S5 correspond to side seals of a finally obtained hair holder. The width of the joints S5 is double the width of each side seal of the hair holder.

The multi-tubular sheet S3 is transferred to the punching unit 63, where holes 15 are punched through the multi-tubular sheet S3, i.e., the sheets S1 and S2, at prescribed positions (see FIG. 1) as shown in FIG. 9(*d*). The multi-tubular sheet S3 punched with the holes 15 is then forwarded to the apparatus 64 according to the present embodiment.

In this step, the multi-tubular sheet S3 is held between the upper block 2 and the lower block 3 of the threading unit at a right position such that the holes 15 of one of the tubes coincide with the apertures of the discontinuous vessels 4A, 4B, 5A, and 5B of the upper block 2 and the lower block 3 on the mating surfaces. In this assembled state, the continuous vessel 6 is evacuated from its second end (exit) by the evacuation unit to generate a high-speed air flow in the vessel 6, and the thread T is continuously introduced into the first end of the vessel 6 by the thread feed unit 7. As a result, the thread T threads through the continuous vessel 6 from the first to the second ends.

Figure 6:
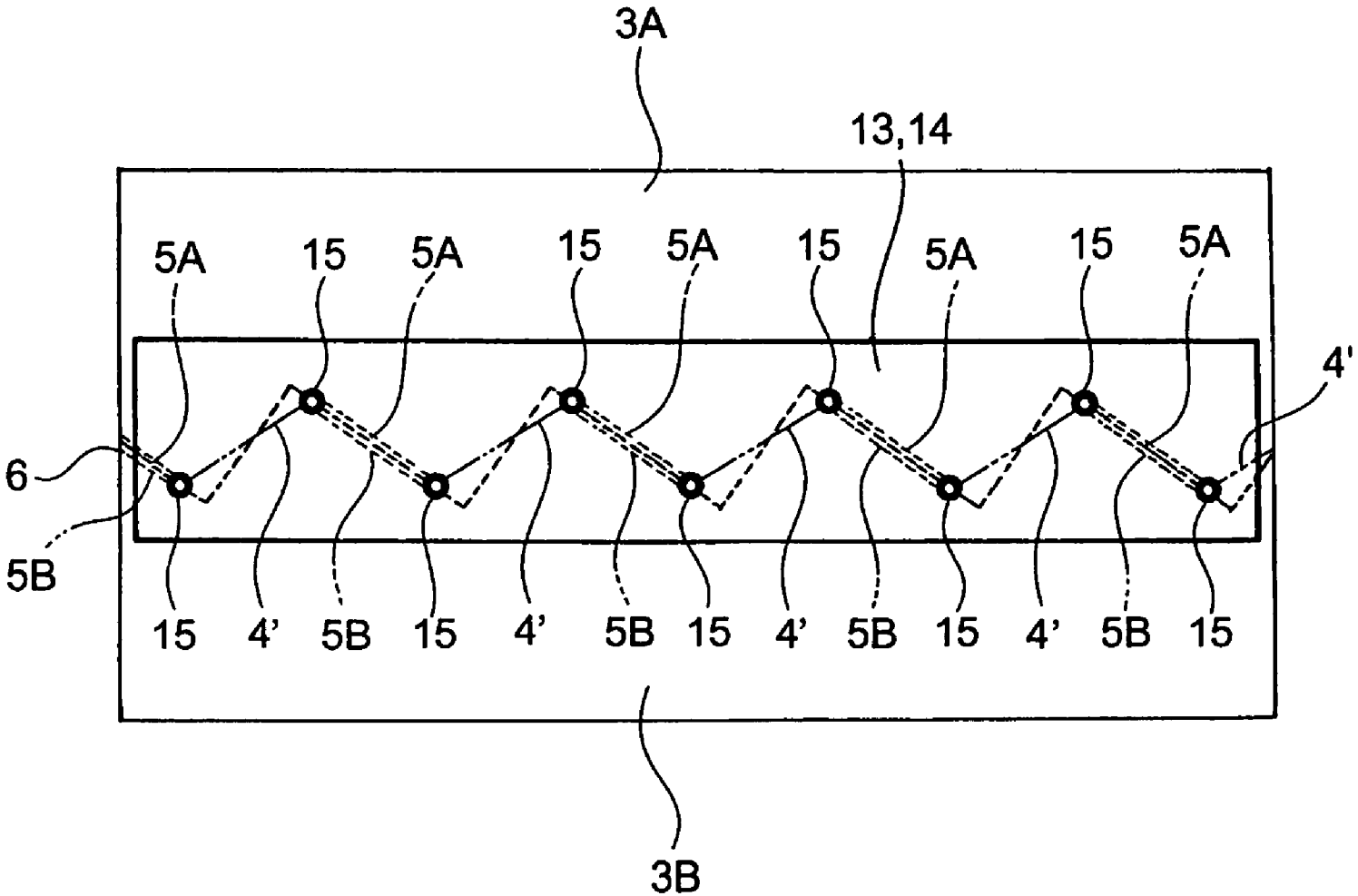
FIG. 6 is a plan of the lower block of the threading unit of FIG. 2, with a flat tube placed thereon at a right position.

The threading step using the apparatus 64 is described in greater detail. The multi-tubular sheet S3 is disposed on the lower block 3 with the holes 15 of one of the tubes coinciding with the apertures of the discontinuous vessel (5A+5B) made in the lower block 3 as shown in FIG. 6. For the sake of simplicity, only one of the tubes of the multi-tubular sheet S3 is depicted in FIG. 6 as if it has been cut out of the multi-tubular sheet S3. The double-dashed-chain line in FIG. 6 indicates the projected discontinuous vessel (4A+4B) of the upper block 2 that is not shown in FIG. 6.

After the multi-tubular sheet S3 is positioned on the lower block 3, the upper block 2 is put thereon with its apertures of the discontinuous vessel (4A+4B) coinciding with those of the discontinuous vessel (5A+5B) of the lower block 3 (see FIG. 10(*a*)). Thus, the continuous vessel 6 passing through the holes 15 of the multi-tubular sheet S3 is completed.

The evacuation unit is then operated to evacuate the continuous vessel 6 from the second end to create a high-speed air flow from the first to the second end. As a result, the thread T fed by the thread feed unit 7 is sucked into the first end and threaded through the continuous vessel 6 while sequentially passing through the holes 15 of the multi-tubular sheet S3 until the leading end of the thread T emerges from the second end of the vessel 6.

Figure 7:
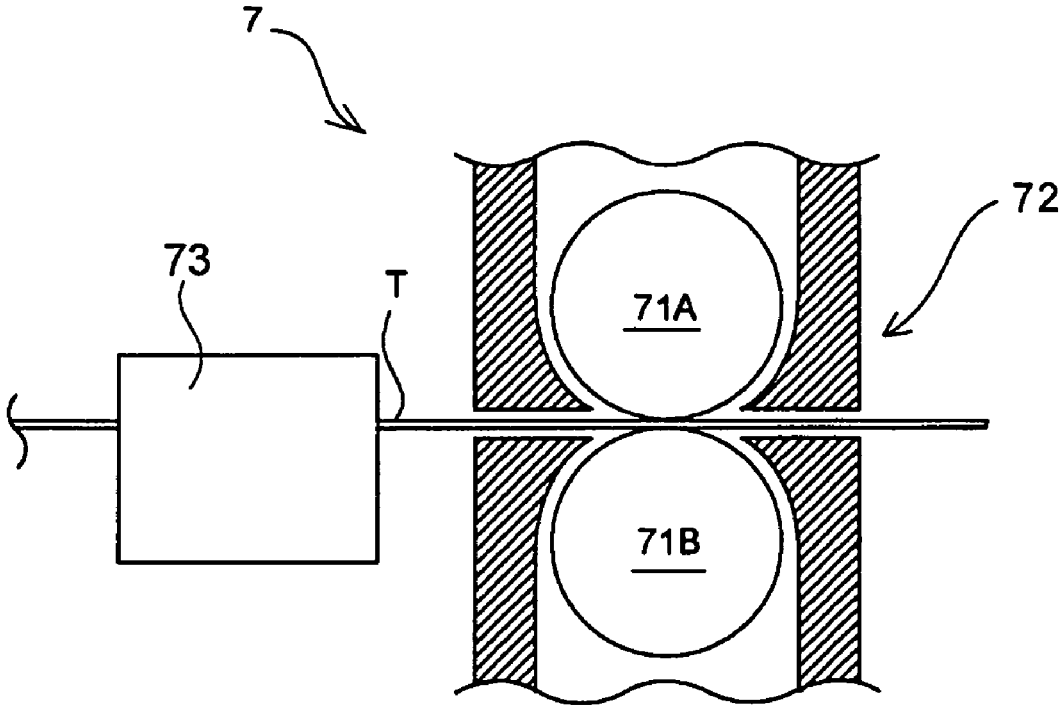
FIG. 7 is a front cross-section of a thread feed unit used in an embodiment of the apparatus for producing a hair holder according to the present invention.

The length of the thread T to be fed from the thread feed unit 7 per tube the rotation of the feed rollers 71A and 71B in a prescribed direction, as shown in FIG. 7, is preferably longer than the length of the wavy continuous vessel 6.

The leading end of the thread T having emerged from the second end of the vessel 6 is once caught by the thread fixing part provided by the side of the evacuation unit. Thereafter, the upper block 2 moves upward while splitting along the parting face. It follows that the part of the thread T that has existed in the discontinuous vessel (4A+4B) in the upper block 2 is exposed and loosened. In the similar manner, the lower block 3 moves downward while splitting along the parting face, and the part of the thread T that has existed in the discontinuous vessel (5A+5B) in the lower block 3 appears.

In this state, the feed rollers 71A and 71B of the thread feed unit 7 rotate in the respective directions reverse to those for thread feeding, whereby the thread T loosely threaded through the continuous vessel 6 is pulled backward to the thread feed unit 7. Since the leading end of the thread T is caught by the thread fixing part near the evacuation unit, the excess of the length of the thread T is returned to the feed side until the thread T comes into contact with the outer surfaces of the sheets S1 and S2 (see FIG. 10(*b*)). The thread T is then cut on the thread feed side. The thread T-threaded part of the multi-tubular sheet S3 is carried to the thread end finishing unit 65.

In the unit 65, a tag 18 and a stopper 19 are attached to one of the free ends of the thread T that is emerging from the hole closest to the reinforced edge of the continuous multi-tubular sheet S3 (see FIG. 1), while the other free end is securely fastened onto the outer side of the sheet S3 near the evacuation unit edge of the sheet S3 (see FIG. 1). The threaded, continuous multi-tubular sheet S3 is sent to the cutting unit 66.

In the unit 66, the multi-tubular sheet S3 is cut across along the longitudinal center line of every joint S5 as indicated in FIG. 10(*c*). Thus, a hair holder shown in FIGS. (1) and 10(*d*) is produced.

The steps of punching, threading, thread end finishing, and cutting are successively carried on every tube of the multi-tubular sheet S3 to produce hair holders of a design in a continuous manner.

The apparatus for producing a hair holder, the threading unit, the threading method, and the method of producing a hair holder according to the above-described embodiments bring about the following effects and advantages. The multi-tubular sheet S3 of continuous length (a continuous row of tubes 12) can instantaneously be threaded with a thread T by sandwiching the sheet S3 between the upper block 2 and the lower block 3 of the threading unit in a right position and evacuating the continuous vessel 6 of the threading unit from the second end of the vessel 6 thereby to thread the thread T through the vessel 6 from the first to the second ends.

On parting the threading unit having the thread T passed through the continuous vessel 6 into the first upper piece 2A, the second upper piece 2B, the first lower piece 3A, and the second lower piece 3B, the thread T remains loose. With the leading end caught, the thread T is pulled backward by the thread feed unit 7 whereby the excess of the thread T can easily and smoothly be removed.

While the present invention has been described with particular reference to its preferred embodiments, various changes and modifications can be made therein without departing from the spirit and scope thereof as follows.

While the threading unit and the threading method of the present invention have been described with respect to the application to the production of a hair holder, specifically how to threading a tubular member, they are useful to thread or lace other sheet-like flat articles with a thread.

In an example, two sheets that are neither in a tube form still less a bag form can be substantially sewed together by superposing them on each other, punching both side areas with holes at a small pitch, and threading a thread through the holes by using the threading unit and the threading method of the invention. The shape of the holes of the sheet-like flat member is usually a circle but may have other various shapes.

The pattern of threading a sheet-like flat member is not limited to the zig zag pattern as in the foregoing embodiments. For instance, a sheet-like flat member can be threaded in a straight line pattern in its plan view.

The threading unit of the invention is not limited to one composed of two blocks that are joined into one body having a single continuous vessel through it. For example, the threading unit may be composed of three or more blocks that are united into one body having two or more continuous vessels threading therethrough. Such a multi-vessel threading unit makes it feasible to achieve two or more threading operations at a time.

The cross-section of the continuous vessel through which a thread is passed is not limited to a circle and may have other shapes including a rectangle and a hexagon as long as the vessel allows a thread to pass through.

The parting line between the first and second pieces of each of the upper and lower blocks is not limited to a zig zag line in a plan view of the threading unit and is decided according to a desired pattern of threading. For example, the parting line may be a straight line.

The shape of the continuous vessel seen through from longer side face of the threading unit is not limited to a wave form composed of half circle arcs alternately protruding upward and downward and may be of any form, such as a normal curve or a zig zag, as long as a thread can be threaded from one end to the other.

The design of a hair holder to be produced by the method and apparatus according to the present invention is not limited to the one shown in FIG. 1. The method and apparatus for producing a hair holder are applicable to any hair holder having a tube with a hair inlet at one end thereof through which a strand of hair can be inserted and a thread for curling the tube, the tube having holes bored at a spacing through it wall, and the thread being sequentially passed through the holes and thereby disposed on the outer side of the tube.

While in the foregoing embodiments a threaded article is obtained by threading a multi-tubular sheet (or a sheet-like flat member) followed by cutting the threaded sheet into individual threaded tubes, the present invention is applicable to threading an dependent tube (or a sheet-like flat member) to obtain a threaded article.

In case where the sucking force generated by the evacuation unit is insufficient when, for example, the continuous vessel is long or the thread is heavy, it is recommended to provide auxiliary suction ports in appropriate positions of the continuous vessel. In that case, it is preferred that the threading unit be designed to detect the position of the leading end of thread and to stop suction from the auxiliary suction ports before the thread passes there.

While the present invention has been described with respect to a hair holder as an example of the threaded article obtainable by the present invention, the threaded article is not limited to such a hair holder.

According to the present invention providing a threading unit, a threading method, a method of making a threaded article, and a method and an apparatus for producing a hair holder, a sheet-like flat member (e.g., a tube) having holes can easily be threaded with a thread.

What is claimed is:

1. A threading unit for threading a flat member having a plurality of holes allowing thread to pass through the flat member, comprising:

an upper block including a plurality of troughs formed within an interior of the upper block and having apertures on an upper block mating face; and a lower block including a plurality of troughs formed within an interior of the lower block and having apertures on a lower block mating face which align with the apertures in the upper block to form a continuous trough within an interior of the threading unit from a first end of the threading unit to a second end of the threading unit positioned opposite to the first end, wherein the lower block is configured to mate with the upper block to form the continuous trough to allow a length of the thread to be threaded therethrough.

2. A method of producing a hair holder by using the threading unit according to claim 1, the hair holder comprising a tube having a hair inlet at one end thereof through which a strand of hair is adapted to be inserted and a thread for curling the tube, the tube having holes bored at a spacing, and the thread being threaded through the holes sequentially and thereby disposed on the outer side of the tube, the method comprising:

sandwiching the tube between the mating faces of the upper and the lower blocks of the threading unit with the holes thereof coinciding with the apertures of the upper and the lower blocks and threading the thread through the continuous vessel of the threading unit from the first end by evacuating the continuous vessel from the second end.

3. The method of producing a hair holder according to claim 2, further comprising:

temporality fixing the leading end of the thread having emerged from the second end of the continuous vessel, splitting both the upper and the lower blocks into the respective first pieces and the respective second pieces, and pulling the thread backward toward the side of thread feed.

4. The threading unit according to claim 1, wherein the upper block includes a first upper piece having a first parting face and a second upper piece having a second parting face, the first parting face and the second parting face each have a portion of the plurality of troughs of the upper block formed thereon.

5. The threading unit according to claim 1, wherein the lower block includes a first lower piece having a first parting face and a second lower piece having a second parting face, the first parting face and the second parting face each have a portion of the plurality of troughs of the lower block formed thereon.

6. A method of threading a threading unit, the threading unit including an upper block including a plurality of troughs formed within an interior of the upper block and having apertures on an upper block mating face, and a lower block including a plurality of troughs formed within an interior of the lower block and having apertures on a lower block mating face which align with the apertures in the upper block to form a continuous trough within an interior of the threading unit from a first end of the threading unit to a second end of the threading unit positioned opposite to the first end, the method comprising:

sandwiching a flat member, which includes a plurality of holes allowing thread to pass through the flat member, between the upper block mating face and the lower block mating face of the threading unit with the plurality of holes of the flat member coinciding with the apertures of the upper block and the lower block; and threading the thread through the continuous trough of the threading unit from the first end of the threading unit by evacuating the continuous trough from the second end of the threading unit.

7. An apparatus for producing a hair holder, comprising:

a threading unit, including an upper block including a plurality of troughs formed within an interior of the upper block and having apertures on an upper block mating face, and a lower block including a plurality of troughs formed within an interior of the lower block and having apertures on a lower block mating face which align with the apertures in the upper block to form a continuous trough within an interior of the threading unit from a first end of the threading unit to a second end of the threading unit positioned opposite to the first end, wherein the lower block is configured to mate with the upper block to form the continuous trough to allow a length of thread to be threaded therethrough;

a thread feed unit to feed a thread to the continuous trough from the first end of the threading unit; and an evacuation unit to evacuate the continuous trough from the second end of the threading unit to thread the thread through the continuous trough from the first end of the threading unit to the second end, wherein the apparatus is configured to have a tube positioned between the upper block mating face and the lower block mating face of the threading unit with holes of the tube being coincident with the apertures of the upper block and the lower block

8. The apparatus according to claim 7, further comprising:

a thread fixing part to fix a leading end of the thread having emerged from the second end of the continuous trough; and a mechanism to pull back the thread with the leading end thereof fixed by a thread fixing part in a direction opposite to a direction of threading.

9. A system for threading, comprising:

a flat member including a plurality of holes;

a threading unit including an upper block including a plurality of troughs formed within an interior of the upper block and having apertures on an upper block mating face, and a lower block including a plurality of troughs formed within an interior of the lower block and having apertures on a lower block mating face which align with the apertures in the upper block to form a continuous trough within an interior of the threading unit from a first end of the threading unit to a second end of the threading unit positioned opposite to the first end, wherein the lower block is configured to mate with the upper block to form the continuous trough to allow a length of thread to be threaded the continuous trough and the flat member.

10. The system according to claim 9, wherein the flat member is a flattened tube or a flattened bag.

11. The system according to claim 9, wherein the length of thread is threaded through the continuous trough from the first end of the threading unit by evacuating the continuous trough from the second end of the threading unit.

12. The system according to claim 9, wherein, when the flat member is positioned between the upper block mating face and the lower block mating face, the plurality of holes of the flat member coincide with the apertures of the upper block and the lower block.

* * * * *